United States Patent [19]

Oikawa

[11] Patent Number: 4,951,935

[45] Date of Patent: Aug. 28, 1990

[54] PAPER STACKER FOR AN IMAGE FORMING APPARATUS

[75] Inventor: Morio Oikawa, Sanriku, Japan

[73] Assignee: Ricoh Company, Ltd., Tokyo, Japan

[21] Appl. No.: 365,854

[22] Filed: Jun. 14, 1989

[30] Foreign Application Priority Data

Jun. 15, 1988 [JP] Japan ..... 63-78305[U]

[51] Int. Cl.[5] ..... B65H 31/10

[52] U.S. Cl. ..... 271/208; 271/217

[58] Field of Search ..... 271/208, 217, 218, 176, 271/213

[56] References Cited

U.S. PATENT DOCUMENTS 3,722,879 3/1973 Johnston ..... 271/217 X 4,033,579 7/1977 Stange ..... 271/217 X 4,687,193 8/1987 Scarabino ..... 271/217 X

*Primary Examiner*—Richard A. Schacher

*Attorney, Agent, or Firm*—Oblon, Spivak, McClelland, Maier & Neustadt

[57] ABSTRACT

A paper stacker for an image forming apparatus is free from jams ascribable to curls of paper sheet which are apt to occur in hot and humid environments, and jams ascribable to static electricity which is apt to deposit on paper sheets in dry environments. When paper sheets are curled due to a large water content, the curl is sensed to inhibit further stacking operations. When paper sheets are electrostatically charged due to a small water content, the charge is dissipated before the paper sheets are stacked. The charge which may remain on a paper sheet having been stacked is immediately discharged when the paper sheet approaches feelers.

4 Claims, 5 Drawing Sheets

PAPER STACKER FOR AN IMAGE FORMING APPARATUS

BACKGROUND OF THE INVENTION

The present invention relates to a device for stacking a large amount of paper sheets which are sequentially driven out of an image forming apparatus.

An electrophotographic copier, facsimile apparatus, printer or similar image forming apparatus is often operated with a stacking device capable of stacking a large amount of paper sheets which are sequentially discharged from the apparatus. A prior device of this kind, i.e., paper stacker has a tray for receiving and stacking paper sheets which are sequentially driven out by a discharge roller. A sensor is associated with the tray and has a feeler which rests on the top of the paper stack on the tray for sensing the level or height of the stack. A driving mechanism moves the tray up and down in response to an output of the sensor, so that the top of the stack may be constantly held at a predetermined height. It is a common practice to provide the sensor with a single feeler which is located in a paper discharging position and at substantially the intermediate between the widthwise opposite edges of paper sheets. This brings about a problem when paper sheets each being curled widthwise are stacked on the tray, the top of the resulting stack being higher at opposite side edges than the center. Specifically, when the side edges of the top of the curled stack becomes higher than the paper discharging position, the leading edge of a paper sheet coming out from the paper discharging position is apt to abut against the opposite edges of the stack to thereby jam the paper feed path. The jam ascribable to the curling of paper sheets frequently occurs in hot and humid environments or when the water content of paper sheets is higher than 8%. Conversely, when the humidity is low or when the water content of paper sheets is less than 6%, a paper sheet becomes a perfect insulator and, therefore, it is apt to gather a charge due to friction. In this condition, it often occurs that the paper sheet adheres to structural members around the path to thereby block the path, resulting in the immediately following paper sheet jamming the path.

SUMMARY OF THE INVENTION

It is therefore an object of the present invention to provide a paper stacker for an image forming apparatus which eliminates jams due to the curling of paper sheets that occurs in hot and humid environments and jams due to static electricity that occurs in dry environments.

It is another object of the present invention to provide a generally improved paper stacker for an image forming apparatus.

A device for stacking paper sheets which are sequentially discharged from an image forming apparatus of the present invention comprises an elevatable tray for receiving and stacking the paper sheets thereon, a position sensor for sensing a position of the top of a stack of the paper sheets on the tray, a drive mechanism for driving the tray up and down such that the highest position of the top of the stack sensed by the position sensor is constantly held at a predetermined position, and a trailing edge sensor disposed above and upstream of the tray with respect to an intended direction of paper feed and making contact with the paper sheet which is discharged from the image forming apparatus, the trailing edge sensor being responsive to an occurrence that a trailing edge of the top of the stack on the tray assumes a position higher than a predetermined position, whereby when the trailing edge sensor senses that the trailing edge of the stack on the tray assumes a position higher than the predetermined position, the image forming apparatus is inhibited from performing any further paper feeding operations.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1B:
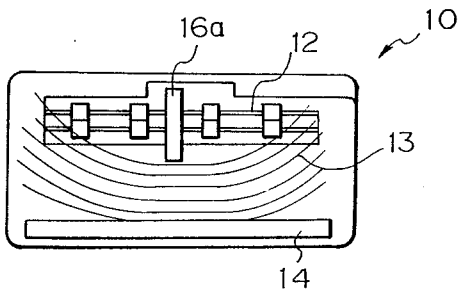
Fig. 1B PRIOR ART
FIGS. 1A, 1B, 2A and 2B are sections showing a prior art paper stacker for an image forming apparatus and useful for understanding problems encountered therewith.
Figure 1A:
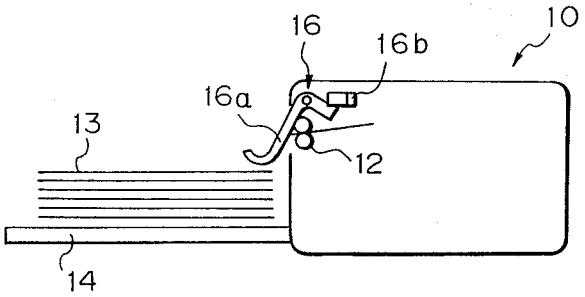
Fig. 1A PRIOR ART

To better understand the present invention, a brief reference will be made to a prior art paper stacker, shown in FIGS. 1A to 2B. As shown, the paper stacker, generally 10, has a tray 14 for receiving and stacking paper sheets 13 which are sequentially driven out of an image forming apparatus by a discharge roller 12. A feeler **16*a* rests on the top of the paper stack on the tray 14, while a sensor 16*b* is associated with and actuated by the feeler 16*a*. The feeler 16*a* and sensor 16*b* constitute in combination a device 16 for sensing the level or height of the top of the paper stack. The tray 14 is moved up and down by a driving mechanism (not shown) which is responsive to an output of the sensing device 16, so that the top of the paper stack on the tray 14** may be maintained at a constant height.

Figure 2B:
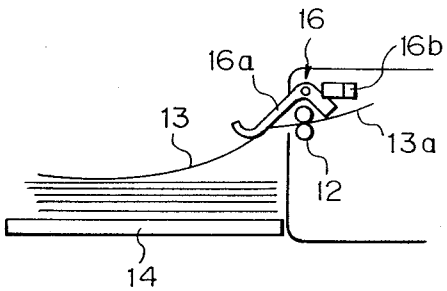
Fig. 2B PRIOR ART
Figure 2A:
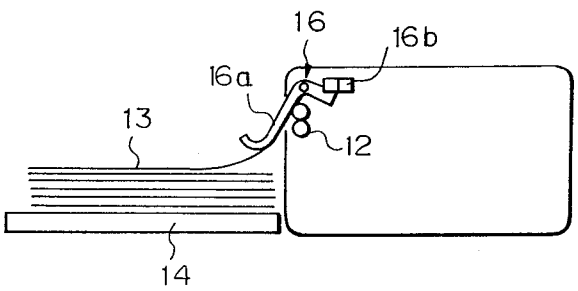
Fig. 2A PRIOR ART

The prior art paper stacker 10 has a single feeler **16*a* which is located at the intermediate between widthwise opposite edges of paper sheets in the paper sheet discharging position, as illustrated. Assume that the paper sheets 13 have a substantial degree of curl, as shown in FIG. 1B. Then, the top of the paper stack on the tray 14 becomes higher at opposite side edges, for example, than at the intermediate where the feeler 16*a* is situated. In this condition, despite that the intermediate portion of the top of the stack is located below the level where the discharge roller 12 discharges a paper sheet, the opposite sides of the top of the stack, especially at the trailing edge thereof, are higher than such a discharging level of the discharge roller 12. This causes a paper sheet being driven out by the discharge roller 12 to abut against the trailing edge of the curled stack on the tray 14 and thereby jam the paper feed path. As discussed previously, the jam ascribable to the curling of paper sheets frequently occurs in hot and humid environments or when the water content of paper sheets is higher than 8%. Conversely, when the humidity is low or when the water content of paper sheets is less than 6%, a paper sheet becomes a perfect insulator and, therefore, it is apt gather a charge due to friction. In this condition, it often occurs that the paper sheet adheres to structural members around the path to thereby block the path, resulting in the immediately following paper sheet jamming the path. For example, assume that the discharge roller 12 discharges a paper sheet 13***a* (FIG. 2B) while a preceding paper sheet 13 which has been charged is adhered to the feeler 16*a* (FIG. 2A). Then, the leading edge of the paper sheet 13*a* abuts against the feeler 16*a* and rotates it upward, but the paper 13 is simply raised by being adhered to the feeler 16*a*, then dropped by gravity, and then caused to shake in the dropped position. As a result, the subsequent paper sheet 13*a* abuts against the shaking paper sheet 13 to bring about a jam.

Figure 3:
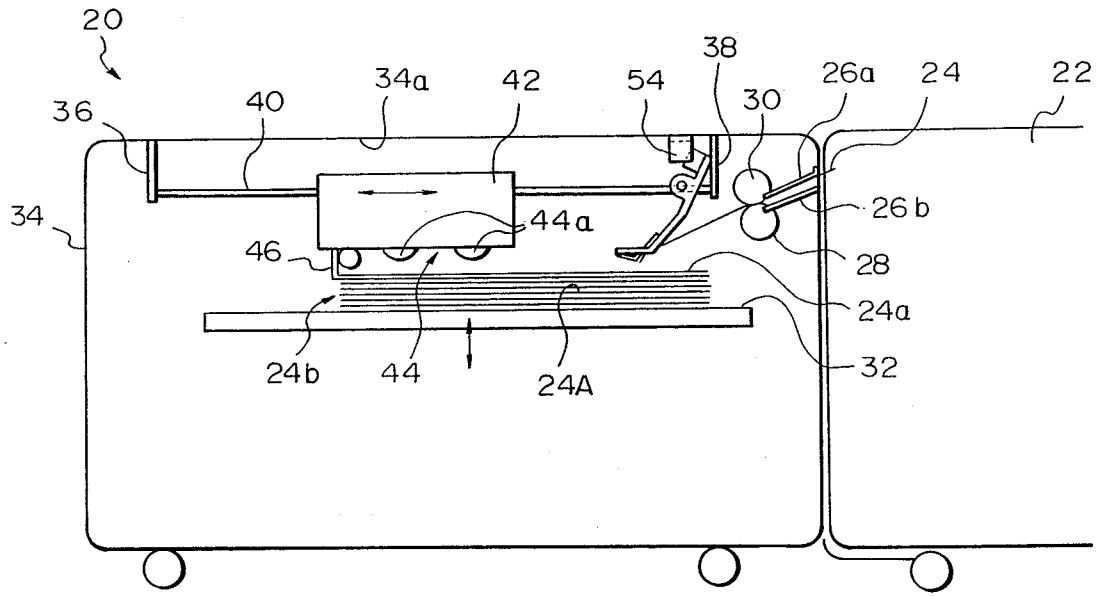
FIG. 3 is a sectional side elevation of a paper stacker for an image forming apparatus embodying the present invention.

Referring to FIG. 3, a paper stacker embodying the present invention is shown and generally designated by the reference numeral 20. The paper stacker 20 is located at the paper outlet side of an image forming apparatus 22 and has thereinside a pair of paper guides 26*a* and 26*b* for guiding a paper sheet 24 which is driven out of the image forming apparatus 22. A feed roller 28 is located in the paper stacker 20 downstream of and in close proximity to the paper guides 26*a* and 26*b*. A pressure roller 30 is held in pressing contact with the feed roller 28 to be driven by the latter. An elevatable tray 32 is accommodated in the paper stacker 20 for stacking thereon the paper sheets 24 which are sequentially discharged by the coactive rollers 28 and 30. A driving mechanism is associated with the tray 32, although not shown in the figure.

The paper stacker 20 has a casing 34. Brackets 36 and 38 are rigidly mounted on the underside of a top wall 34*a* of the casing 34, while a pair of parallel guide rails 40 are securely supported at opposite ends thereof by the brackets 36 and 38 to extend in an intended direction of paper feed in the casing 34. A carrier 42 is slidably mounted on the parallel guide rails 40. Mounted on the carrier 42 are a sensing device 44 which is responsive to the height or level of the top 24*a* of a paper stack 24A on the tray 32, and a mechanism 46 for neatly arranging the leading edge of a paper sheet 24. In this configuration, a paper sheet 24 simply driven into the casing 34 by the coactive rollers 28 and 30 is stacked on the tray 32 by having its leading edge 24*b* located in a predetermined position by the mechanism 46. While the carrier 42 slides on the guide rails 40, the sensing device 44 senses the height of the top 24*a* of the paper stack 24A at various portions of the latter. In response to the output of the sensing device 44, the drive mechanism is controlled to move the tray 32 up or down such that the height of the top 24*a* of the paper stack 24A as measured at the highest portion of the latter coincides with a predetermined height.

Assume that the paper sheets 24 on the tray 32 have curls and, therefore, the top 24*a* of the stack 24A is different in height from the leading edge to the trailing edge. Even in such a condition, the paper stacker 20 having the above construction prevents a paper sheet 24 being fed by the feed roller 28 and pressure roller 30 from abutting against the trailing edge 24*c* of the paper stack 24A or from being caught by an upwardly protruding portion of the paper stack 24A and an overlying member.

Figure 4:
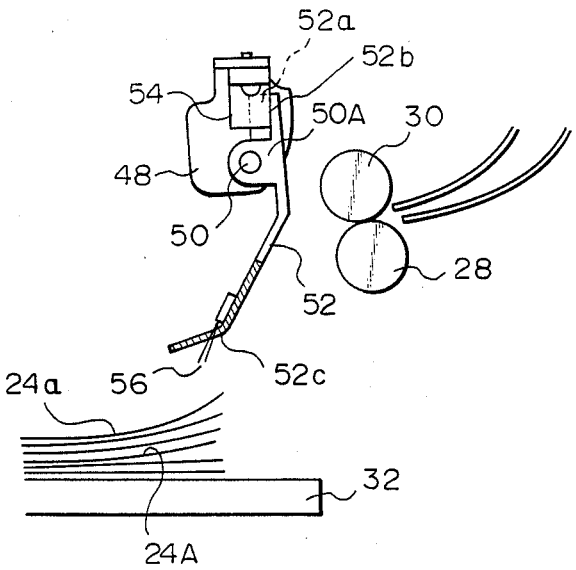
FIG. 4 is a fragmentary side elevation showing a trailing edge sensing device which is included in the paper stacker of FIG. 3 for sensing the trailing edge of a paper sheet.
Figure 5:
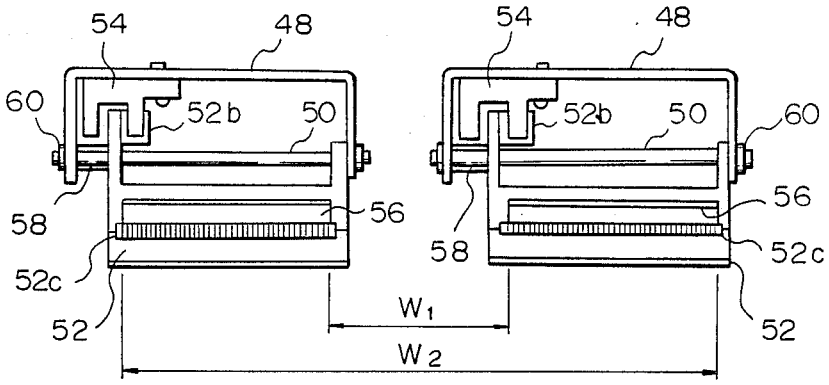
FIG. 5 is a front view of the trailing edge sensing device.

As shown in FIGS. 4 and 5, in the illustrative embodiment, a trailing edge sensing device responsive to the trailing edge of the paper stack 24A is situated downstream of and in close proximity to the feed roller 28 and pressure roller 30. Specifically, two brackets 48 are rigidly mounted on the top wall 34*a* of the casing 34 while being spaced apart from each other in a direction perpendicular to the intended direction of paper transport, i.e. in the lateral direction. A shaft 50 is fixed to each of the brackets 48 to extend in the lateral direction. A feeler 52 is rotatably mounted on each shaft 50. As shown in FIG. 5, each of the right and left feelers 52 has a lower edge or paper contacting edge extending in the lateral direction over a range in which the side edge of a paper sheet 24 having a minimum width $W_1$ and that of a paper sheet 22 having a maximum width $W_2$, which are usable with the paper stacker 20, may pass. The feelers 52 are individually supported by their associated shafts 50 at two points of the latter. Each feeler 52 has an extension extending upward from one, 50A, of the two points where it is supported by the associated shaft 50. A photosensor 54 is securely mounted on the bracket 48, while the upward extension of the feeler 52 has an intercepting plate 52*a* for blocking the optical path of the photosensor 54. The upward extension of the feeler 52 further has a stop 52*b* for preventing the feeler 52 from rotating counterclockwise, as viewed in FIG. 4, beyond a position where the intercepting plate 52*a* blocks the optical path, as mentioned above. A slot 52*c* is formed through the feeler 52 in the vicinity of and parallel to the lower edge of the latter and substantially over the entire width of the feeler 52. A charge dissipating or discharge brush 56 has bristles protruding downward through the slot 52*c*. The brush 56 is removably fitted at its base portion on the surface of the feeler 52 by a two-sided adhesive tape, for example. The brush 56 is implemented by a bundle of conductive fibers having a diameter of several microns, e.g. stainless steel fibers. The feeler 52 is made of conductive resin and, in principle, connected to ground. As shown in FIG. 4, so long as the feeler 52 is entirely spaced apart from the top 24*a* of the paper stack 24A, the feeler 52 remains rotated downward due to gravity. In this position, the stop 52*b* abuts against the photosensor 54, and the intercepting plate 52*a* blocks the optical path of the photosensor 54. In the figures, the reference numerals 58 and 60 designate respectively a spacer for positioning the feeler 52 in the axial direction, and a retainer ring for preventing the shaft 50 from slipping out.

Figure 6:
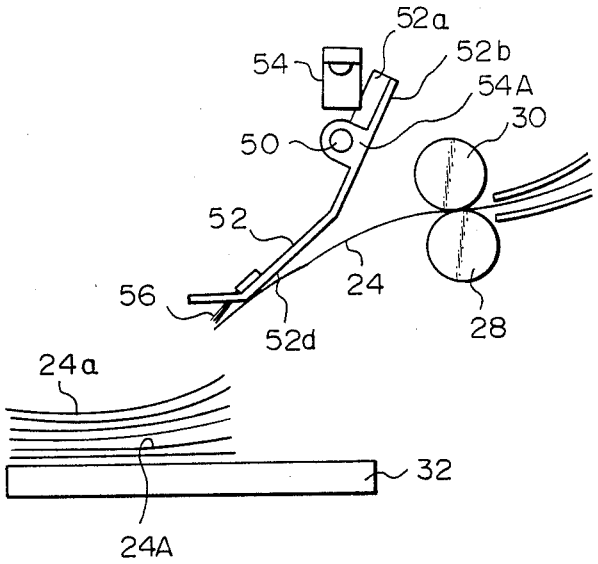
FIGS. 6 to 8 are views demonstrating the operation of the trailing edge sensing device.
Figure 7:
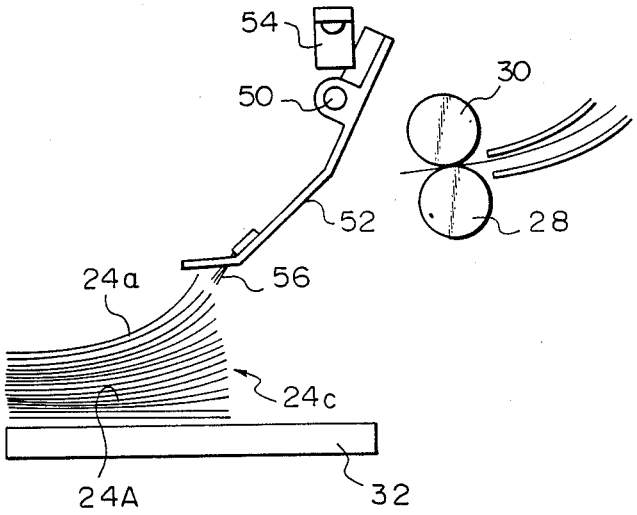

As shown in FIG. 6, when the feed roller 28 and pressure roller 30 drive a paper sheet 24 toward the tray 32, the leading edge of the paper sheet 24 abuts against the lower edge 52*d* of each feeler 52. Consequently, each feeler 52 is rotated clockwise about the associated shaft 50 to unblock the optical path of the photosensor 54. In this instance, the output of the sensor 54 is not sampled while the coactive rollers 28 and 30 are feeding a paper sheet 24, i.e., it is sampled only when a paper sheet 24 has moved away from the rollers 28 and 30. The paper stacker 20 is controlled such that stacking is continued when the optical paths of both of the photosensors 54 are blocked and is interrupted when either one of the optical paths is unblocked.

Specifically, when the paper sheets 24 have a substantial water content due to a hot and humid environment and are therefore noticeably curled upward, the trailing edge 24*c* of the paper stack 24A on the tray 32 raises the feelers 52 to thereby unblock the optical paths of the photosensors 54. Then, the image forming apparatus 22 does not perform any further paper feeding motions while continuing its motions for discharging paper sheets 24 which are positioned upstream of the coactive rollers 28 and 30. A paper sheet 24 being driven by the rollers 28 and 30 toward the tray 32 urges each feeler 52 upward slightly more than the trailing edge of the uppermost paper sheet of the stack urges it upward, so that paper sheets 24 which are usually expected to be present on the transport path can be successfully stacked on the tray 32. As stated above, even when a paper sheet 24 having a substantial curl due to a hot and humid environment is stacked on the tray 32, the shape of the trailing edge of the paper sheet 24 is determined at a particular point in the widthwise direction where the curl is greatest. This eliminates a jam which the next paper sheet 24 would otherwise cause by abutting against the trailing edge of the paper stack on the tray 32.

Figure 8:
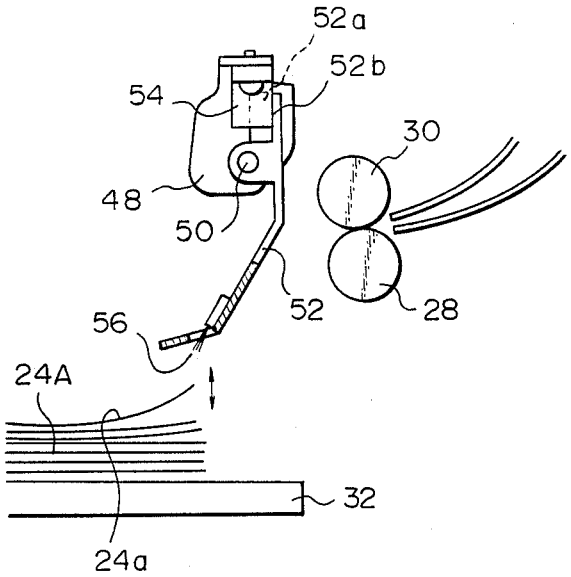
Figure 9:
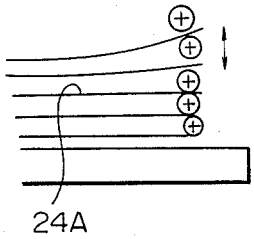
FIG. 9 is a view representative of an occurrence that a paper sheet having been charged tends to rise away from an underlying charged paper sheet.

Furthermore, the paper sheet 24 being driven by the rollers 28 and 30 passes the discharge brush 56 in contact with or substantially in contact with the tips of its bristles. Hence, a charge which may be deposited on the paper sheet 24 in a dry environment is dissipated, so that the paper sheet 24 is inhibited from adhering to the structural elements of the paper stacker 20. Assume that a charge is left on the paper sheet 24 due to inaccurate settings of paper sheets and brush 56, in the condition shown in FIG. 8. Then, as illustrated in FIG. 9, the paper sheets 24 having been charged to the same polarity repel each other and, hence, the uppermost paper sheet 24 rises, then drops due to gravity, and then rises again due to the respulsive force. Repeating such motions, the trailing edge of the uppermost paper sheet 24 shakes buoyantly. As such motions of the uppermost paper sheet 24 become intense, the paper sheet 24 tends to adhere to the feeler 52. However, when the paper sheet 24 approaches the feeler 52, the charge of the paper sheet 24 is dissipated by the tip of the brush 56. Consequently, the paper sheet 24 is successfully stacked on the underlying paper 24 without repeling the latter or adhering to the feeler 52.

In general, the phenomenon that the paper sheet 24 shakes buoyantly away from the underlying paper sheet occurs when the charge potential of the paper sheet 24 is several kilovolts. Experiments showed that the illustrative embodiment halves the charge potential on the paper sheet 24 and thereby eliminates the above-stated phenomenon. Further, when a paper sheet charged to several kilovolts was intentionally brought close to the feeler 52, the feeler 52 caused it to discharge and allowed a minimum of potential to remain thereon, perfectly freeing the paper sheet from adhesion and even from shaking.

In summary, the present invention provides a paper stacker which is free from paper jams with no regard to the ambient conditions. Specifically, when paper sheets are curled due to a large water content thereof, the curl is sensed to inhibit any further stacking operation. Conversely, when paper sheets are charged due to a small water content, the charge is dissipated before the paper sheets are stacked. Although the charge may remain on a paper sheet which has been stacked, it is immediately discharged when the paper sheet approaches feelers.

Various modifications will become possible for those skilled in the art after receiving the teachings of the present disclosure without departing from the scope thereof.

What is claimed is:

1. A device for stacking paper sheets which are sequentially discharged from an image forming apparatus, comprising:

an elevatable tray for receiving and stacking the paper sheets thereon;

position sensing means for sensing a position of the top of a stack of the paper sheets on said tray;

drive means for driving said tray up and down such that the highest position of the top of the stack sensed by said position sensing means is constantly held at a predetermined position; and trailing edge sensing means disposed above and upstream of said tray with respect to an intended direction of paper feed and making contact with the paper sheet which is discharged from the image forming apparatus, said trailing edge sensing means being responsive to an occurrence that a trailing edge of the top of the stack on said tray assumes a position higher than a predetermined position;

whereby when said trailing edge sensing means senses that the trailing edge of the stack on said tray assumes a position higher than the predetermined position, the image forming apparatus is inhibited from performing any further paper feeding operations.

2. A device as claimed in claim 1, wherein said trailing edge sensing means comprises a pair of feelers each having a contact surface which extends horizontally in a widthwise direction of the paper sheets over a range in which an outer edge of a paper sheet having a minimum width and an outer edge of a paper sheet having a maximum width, which are usable with said device, may pass;

said contact surface of said feeler guiding the paper sheet being discharged from the image forming apparatus while sliding on said paper sheet;

said contact surface of said feeler contacting the trailing edge of the top of the stack on said tray only when said trailing edge assumes a position higher than the predetermined position; and sensors each being actuated by respective one of said feeler.

3. A device as claimed in claim 2, wherein said trailing edge sensing means further comprises self-discharging brushes each protruding from said contact surface of respective one of said feelers and, when the paper sheet passes said contact surface, dissipating a charge remaining on said paper sheet.

4. A device as claimed in claim 1, further comprising a carrier loaded with said position sensing means and movable above said tray in the intended direction of paper feed.

* * * * *